US006820284B2

(12) United States Patent
Horikoshi et al.

(10) Patent No.: US 6,820,284 B2
(45) Date of Patent: Nov. 23, 2004

(54) MALE SUPPORTER

(75) Inventors: Akira Horikoshi, Chiba (JP); Takashi Yasukawa, 31-13, Higashi Koiwa 5-chome, Edogawa-ku, Tokyo (JP)

(73) Assignee: Takashi Yasukawa, Tokyo (JP)

( * ) Notice: Subject to any disclaimer, the term of this patent is extended or adjusted under 35 U.S.C. 154(b) by 0 days.

(21) Appl. No.: 10/661,278

(22) Filed: Sep. 12, 2003

(65) Prior Publication Data

US 2004/0049835 A1 Mar. 18, 2004

(51) Int. Cl.[7] ..... A41B 9/02
(52) U.S. Cl. ..... 2/400; 2/403
(58) Field of Search ..... 2/400, 405, 403, 2/228, 238, 227; 602/67–72; 604/385.01, 385.19, 393–400

(56) References Cited

U.S. PATENT DOCUMENTS 2,035,604 A * 3/1936 Ide ..... 602/67
2,050,410 A * 8/1936 Baer ..... 602/69
2,058,970 A * 10/1936 Fiesh ..... 602/67
4,702,239 A * 10/1987 Ichikawa ..... 602/67
5,070,869 A * 12/1991 Zhang ..... 602/67
5,226,179 A * 7/1993 Choi ..... 2/403
5,283,912 A * 2/1994 Chung ..... 2/403
6,038,703 A * 3/2000 Chung ..... 2/403
6,295,651 B1 * 10/2001 Kang ..... 2/403

FOREIGN PATENT DOCUMENTS

JP 6-20405 A1 3/1994
JP 9003701 A1 1/1997

* cited by examiner

*Primary Examiner*—Gloria M. Hale
(74) *Attorney, Agent, or Firm*—Darby & Darby

(57) ABSTRACT

A male supporter includes a lower piece which covers the scrotum from underneath, an upper piece which is formed by belt-like cloth along the penis and covers the penis from the front side, and a pair of suspending devices which are connected to both left and right edges of the upper piece or the lower piece. A back edge of the lower piece is connected to an inner crotch of the underpants via an elastic axis device. A top edge of the upper piece is connected to an upper central part of the underpants. The ends of the suspending devices are connected to the upper left and right of the inside of the underpants. Accordingly, the whole male organs are independently supported. This male supporter has excellent permeability and can retain the whole male organs independently with a sense of stability.

8 Claims, 3 Drawing Sheets

MALE SUPPORTER

BACKGROUND OF THE INVENTION

1. Field of the Invention

The present invention relates to male supporter which is fitted to male underpants for retaining male organs (which denotes the penis and scrotum hereunder).

2. Description of Related Art

Conventionally, as underpants for retaining male organs, trunks type underpants disclosed in Japanese Patent No. 2923247 (Japanese Patent Application, First Publication No. Hei 9-3701), male underpants disclosed in Japanese Utility Model Application, Second Publication No. Hei 7-40482 (Japanese Utility Model Application, First Publication No. Hei 6-20405), and the like have been proposed.

The former trunks type underpants are formed as a one piece cut of supporter and trunks type underpants, with the object of providing trunks type underpants with permeability and a sense of stability.

On the other hand, regarding the latter male underpants, a cloth is arranged on an inner part of the underpants functioning as a pocket to contain the male organs, and the cloth forms an approximate U-shape. As a result, when the male organs are put into the pocket, the male organs are supported from underneath.

Further, as underpants for retaining the male organs, many underpants with the object of providing permeability and a sense of stability have been proposed.

However, since the former trunks type underpants are formed as a one piece cut of supporter and underpants, considerable bothersome time and labor is required for such operations as cutting and sewing. Due to this considerable time and labor, the production cost of the trunks type underpants is expensive.

On the other hand, regarding the latter male underpants, the cloth functioning as a pocket is formed separate from the underpants, and then sewn on. Therefore it is possible to provide a lower price compared to the former trunks type underpants. The cloth functioning as a pocket forms an approximate U-shape by means of a main part which supports the male organs from underneath and a pair of arm parts which are extended upwards from the main part. As a result, the male organs are supported from underneath and kept from directly touching the legs, so that discomfort can be reduced. However, regarding the cloth functioning as a pocket, the main part which supports the male organs from underneath only supports the scrotum of the male organs and does not retain the penis. In other words, the structure of these male underpants is to separately support the scrotum and penis so that there is a sense of discomfort in the fitting of the overall male organs.

Moreover, male organs are not ones which are always contained in the same condition, being special organs whose shape and volume changes moment by moment due to various factors. Nevertheless, many male underpants proposed up to now with the object of providing permeability and a sense of stability, have not considered this special characteristics of male organs.

Therefore, the present invention has been created in order to solve the aforementioned problems, with the object of providing a male supporter with excellent permeability and which can retain the whole male organs independently with a sense of stability, and moreover, which can adapt to the special sorts of change of the male organs and can fit well in any condition.

SUMMARY OF THE INVENTION

One aspect of the present invention is a male supporter which is fitted to an inner part of male underpants. The male supporter comprises; a lower piece which covers the scrotum from underneath, an upper piece which is formed by belt-like cloth along the penis and covers the penis from the front side, and a pair of suspending devices which are connected to both left and right edges of the upper piece or the lower piece. A back edge of the lower piece is connected to an inner crotch of the underpants via an elastic axis device. A top edge of the upper piece is connected to an upper central part of an inner front body of the underpants. The ends of the suspending devices are connected to the upper left and right of the inner front body of the underpants. Accordingly, the whole male organs are independently supported.

The lower piece may be formed by a peripheral edge which is formed in an approximate circle shape, and a part which envelops the scrotum.

The suspending devices and elastic axis device may be formed by elastic thread or belt-like elastic cloth.

A retaining piece for holding the penis may be provided on an inner part of the upper piece.

According to the male supporter of the present invention, the whole male organs are covered by the lower piece and the upper piece, and in this condition the suspending devices support the male organs independently. Moreover, by a pendulum-like restoring effect and elastic effect of the elastic axis device, it is possible to keep the male organs always in the central position, and correspond to the shape and volume change of the male organs.

DETAILED DESCRIPTION OF THE INVENTION

Hereunder is a description of embodiments of a male supporter according to the present invention with reference to the drawings. However, the present invention is not limited to the following embodiments and may be variously modified, for example, by adding well-known structure or the like.

Figure 1:
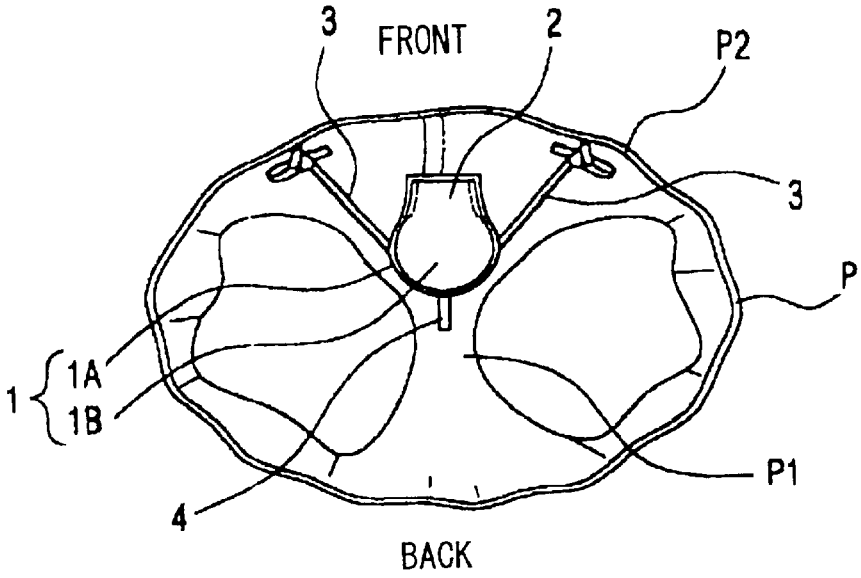
FIG. 1 is a plan view of a fitted condition showing an embodiment of a male supporter of the present invention.

As shown in FIG. 1, the correction device of this embodiment is a male supporter used to fitted to an inner part of male underpants P. The male supporter comprises; a lower piece 1, an upper piece 2, suspending devices 3, and an elastic axis device 4.

The lower piece 1 is cloth-like to cover the scrotum from underneath, and comprises; a peripheral edge 1A formed in an approximate circle shape, and a part 1B which envelops the scrotum. A high retentivity can be obtained by the lower piece, the whole of which is curved like a crab shell (refer to FIG. 1). For the lower piece 1, a flat cloth may be used. To the back edge of the lower piece 1, is connected the elastic axis device 4 which is described later.

Figure 2:
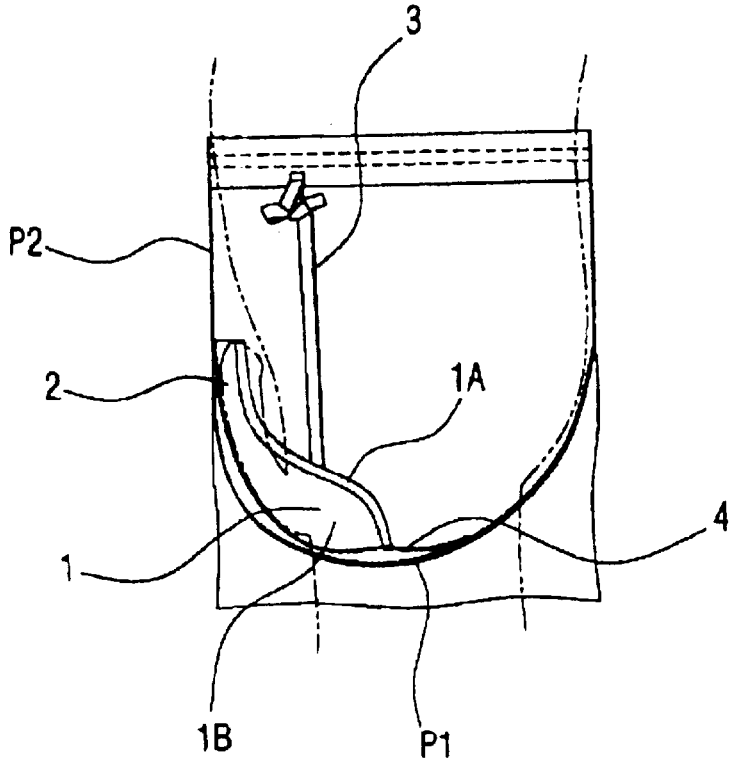
FIG. 2 is a side cross-section of a fitted condition showing the same embodiment.
Figure 3:
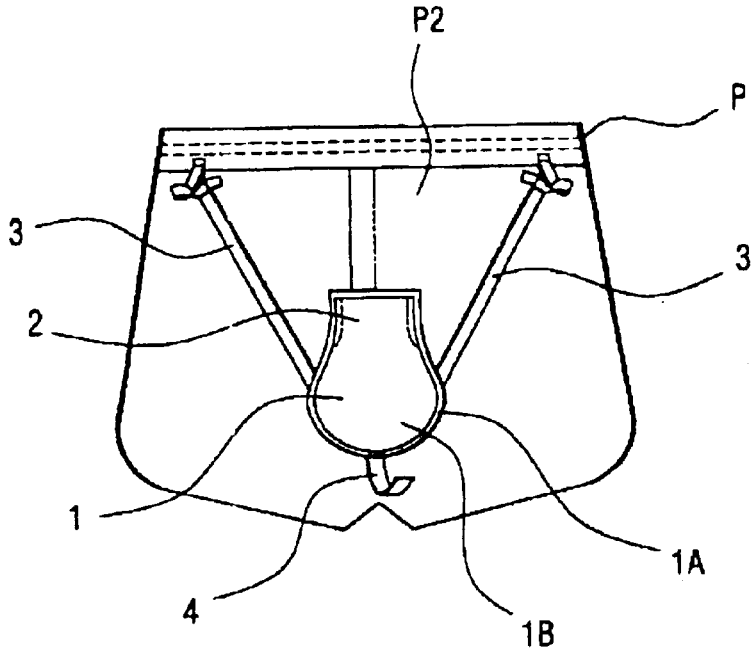
FIG. 3 is a longitudinal cross-section of a fitted condition of the same embodiment viewed from behind.
Figure 4:
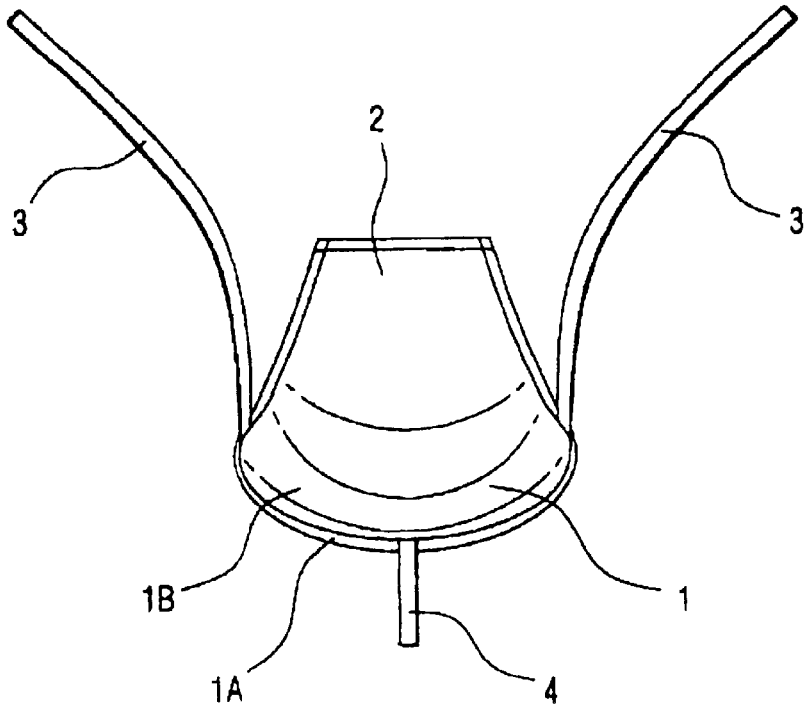
FIG. 4 is a development plan showing the same embodiment.
Figure 5:
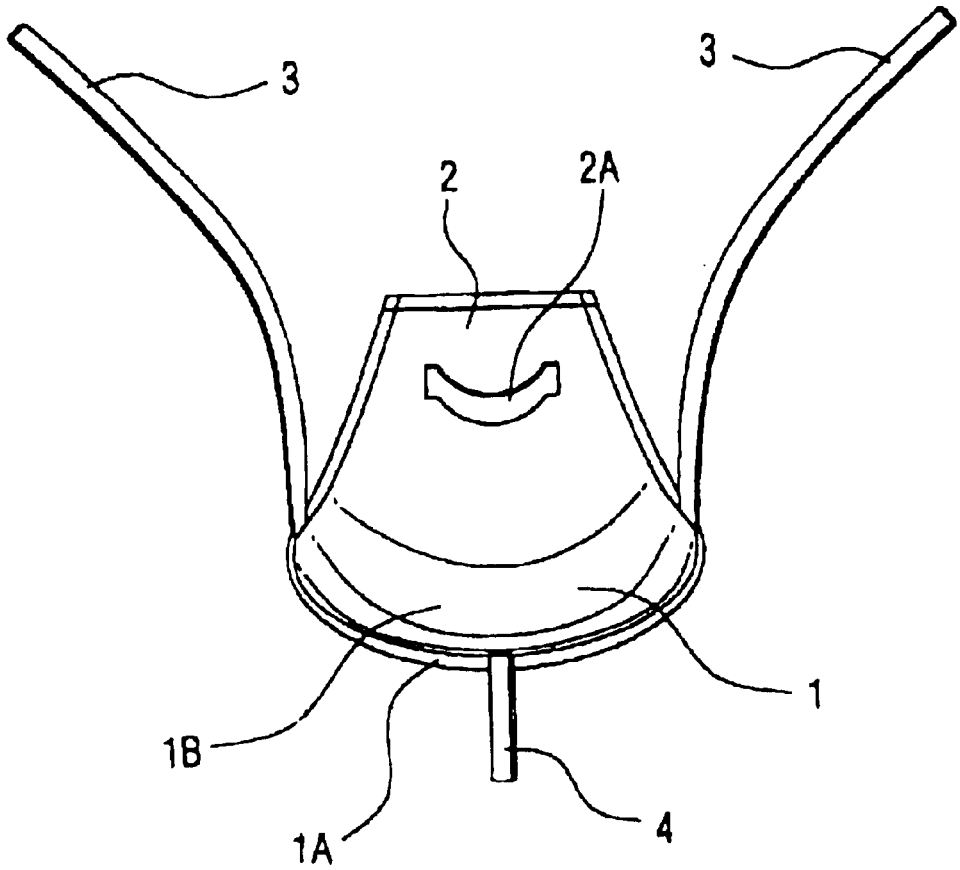
FIG. 5 is a development plan showing an other embodiment.

The upper piece 2 is formed by a belt-like cloth along the penis, which covers and retains the penis from the front side (refer to FIG. 2). The top edge of the upper piece 2 is connected to an upper central part of a front body P2 of the underpants P. Regarding the connection of the upper piece 2, sewing is the most preferable, however, it is possible to connect by other detachable connecting means, for example, a snap button, a surface fastener, or the like. As shown in FIG. 5, a retaining piece 2A which holds the penis may be arranged on the inside of the upper piece 2. In this case, the penis can be retained more reliably.

The pair of suspending devices 3 are connected to both the left and right edges of the upper piece 2 or the lower piece 1. For easier urination, an outlet 2B (not shown) may be provided in a part of the upper piece 2.

The suspending devices 3 are for suspending the whole male organs by connecting from both sides of the lower piece 1 or the upper piece 2 to the upper left and right sides of the inner front body P2 of the underpants P (refer to FIG. 2). Regarding the suspending devices 3, in order to correspond to the swing or movement of the whole male organs, it is preferable to use elastic thread, belt-like elastic cloth or other elastic material, however, it is possible to use normal cloth. Regarding the connecting device for the suspending devices 3 and the lower piece 1 or the upper piece 2, sewing means is preferable. Moreover, by tying up to give a freely adjustable length as shown in the drawings, it is possible to suspend in the most preferable condition for the user. Regarding the connecting device of the suspending devices 3 and the underpants P, besides the sewing means, it is possible to connect by some other detachable connecting device such as the aforementioned snap button, dot button, surface fastener or the like.

The elastic axis device 4 connects from the back side of the lower piece 1 to the inner crotch P1 of the underpants P, and centering of the elastic axis device 4 brings the male organs back to the normal position (refer to FIG. 1). Since the elastic axis device 4 is connected to the inner crotch P1, then in order to connect without specific discomfort, it is preferable to connect with elastic thread, belt-like cloth or the like by sewing means.

The male supporter of this embodiment is sewn onto the inner part of the underpants P, however, it is also possible to be separate from the underpants P. Regarding the type of underpants P on which the correction device of the present invention is fitted, trunks types are mainly assumed, however, it is also possible to fit this to other underpants P such as brief types.

By configuring the male supporter as mentioned above, the following effects are demonstrated.

(1) Since there is provided the lower piece 1 which covers the scrotum from underneath and the upper piece 2 which is formed by belt-like cloth along the penis and covers the penis from the front side, and these are suspended by the pair of suspending devices 3, the whole of the male organs can be independently supported. As a result, the male organs are prevented from hanging down as with conventional underpants, and the line from the crotch to the cuff become good-looking. Furthermore, it is possible to make the line from the crotch to the cuff look longer.

(2) Since the back edge of the lower piece 1 is connected via the elastic axis device 4, and the elastic axis device 4 is connected to the inner crotch P1 of the underpants P, it become possible to keep the male organs always in the central position and to correspond to shape and volume change of the male organs. Consequently, it becomes possible to not only reliably retain the male organs despite vigorous movement, but to also always retain the male organs in a certain position despite changes of the male organs.

(3) Since the lower piece 1 is formed by the peripheral edge 1A formed in an approximate circle shape and the part 1B which envelops the scrotum, the scrotum is fitted well so that it is possible to reliably retain the male organs.

(4) By forming the suspending devices 3 and the elastic axis device 4 with elastic thread or belt-like elastic cloth, then when the underpants are worn, the suspending devices 3 and the elastic axis device 4 do not give discomfort to the user.

(5) By providing the retaining piece 2A which holds the penis, on the inside of the upper piece 2, it is possible to more reliably hold the male organs.

Consequently, the device demonstrates such effects as having excellent permeability, while being able to retain the whole male organs independently with a sense of stability, and also adapting to the special changes of the male organs and fitting well in all conditions.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A male supporter to be fitted to an inner part of male underpants, comprising:

a lower piece to cover the scrotum from underneath;

an upper piece formed by belt-like cloth to extend upward from an upper side of said lower piece and to cover the penis from the front side;

a pair of suspending devices, one being connected to respective left and right edges of said lower piece; and an elastic axis device having one end connected to a back edge of said lower piece and another end to be connected to an inner crotch of said underpants, wherein a top edge of said upper piece is to be connected to an upper central part of an inner front body of the underpants, and ends of said suspending devices are to be connected to an upper left portion and an upper right portion of the inner front body of the underpants.

2. A male supporter according to claim 1, wherein said lower piece has a peripheral edge which is formed in an approximate circle shape, and a part which envelops the scrotum.

3. A male supporter according to claim 1, wherein said suspending devices and said elastic axis device are formed by elastic thread or belt-like elastic cloth.

4. A male supporter according to claim 1, wherein a retaining member for holding the penis is provided on an inner part of said upper piece.

5. The combination comprising:

a pair of male underpants;

a male supporter fitted to an inner part of said underpants and comprising:

a lower piece to cover the scrotum from underneath;

an upper piece formed by belt-like cloth to extend upward from an upper side of said lower piece and to cover the penis from the front side;

a pair of suspending devices, one being connected to respective left and right edges of said lower piece and the other end of each being connected to said underpants; and an elastic axis device having one end connected to a back edge of said lower piece and another end connected to an inner crotch of said underpants;

wherein a top edge of said upper piece is connected to an upper central part of an inner front body of said underpants, and ends of said suspending devices are connected to an upper left portion and an upper right portion of the inner front body of said underpants.

6. The combination according to claim 5, wherein said lower piece has a peripheral edge which is formed in an approximate circle shape, and a part which envelops the scrotum.

7. The combination according to claim 5, wherein said suspending devices and said elastic axis device are formed by elastic thread or belt-like elastic cloth.

8. The combination according to claim 5, wherein a retaining member for holding the penis is provided on an inner part of said upper piece.

* * * * *